US005828933A

United States Patent [19]

Rees et al.

[11] Patent Number: 5,828,933

[45] Date of Patent: Oct. 27, 1998

[54] ADDITIVE COLOR RECHARGE, EXPOSE, AND DEVELOP ELECTROPHOTOGRAPHIC PRINTING

[75] Inventors: James D. Rees, Pittsford; Charles H. Tabb, Rochester, both of N.Y.

[73] Assignee: Xerox Corporation, Stamford, Conn.

[21] Appl. No.: 976,943

[22] Filed: Nov. 24, 1997

[51] Int. Cl.[6] ..... G03G 15/01

[52] U.S. Cl. ..... 399/223

[58] Field of Search ..... 399/223, 178, 399/54, 51, 171

[56] References Cited

U.S. PATENT DOCUMENTS

| | | | |
|---|---|---|---|
| 4,661,703 | 4/1987 | Ishikawa et al. | 347/118 X |
| 5,023,632 | 6/1991 | Yamamoto et al. | 399/178 X |
| 5,032,852 | 7/1991 | Fujii et al. | 399/178 X |
| 5,184,146 | 2/1993 | Tanaka et al. | 347/232 |
| 5,208,796 | 5/1993 | Wong et al. | 369/97 |
| 5,252,995 | 10/1993 | Trask et al. | 347/119 |
| 5,272,493 | 12/1993 | Hubble et al. | 347/116 |
| 5,386,223 | 1/1995 | Saitoh et al. | 347/115 |
| 5,418,097 | 5/1995 | Furuya et al. | 399/223 X |
| 5,438,401 | 8/1995 | Murayama et al. | 399/171 X |
| 5,515,155 | 5/1996 | Folkins | 399/223 |
| 5,537,198 | 7/1996 | Jackson | 399/168 |
| 5,581,330 | 12/1996 | Pietrowski et al. | 399/171 |
| 5,600,430 | 2/1997 | Folkins et al. | 399/171 |
| 5,752,137 | 5/1988 | Haneda | 399/223 |

FOREIGN PATENT DOCUMENTS 2122-2H 12/1989 Japan .

*Primary Examiner*—S. Lee
*Attorney, Agent, or Firm*—John M. Kelly

[57] ABSTRACT

REaD(Recharge Expose and Develop) electrophotographic printing using additive color toners and inhibited image on image development. Inhibited image on image development is achieved by setting the exposure set points such that exposure losses incurred when imaging through previously developed toner reduces the electrostatic potential for developing over the developed toner, by using a DC corona system during recharging so as to enhance the voltage drop across the previously developed toner(s), and/or by increasing the developed toner mass to increase the thickness of the dielectric properties of the developed toner.

6 Claims, 2 Drawing Sheets

ADDITIVE COLOR RECHARGE, EXPOSE, AND DEVELOP ELECTROPHOTOGRAPHIC PRINTING

FIELD OF THE INVENTION

This invention relates to electrophotographic color printers that use additive colors.

BACKGROUND OF THE INVENTION

Electrophotographic marking is a well known and commonly used method of copying or printing documents. Electrophotographic marking is performed by exposing a light image representation of a desired document onto a charged photoreceptor. In response to that light image the photoreceptor discharges, creating an electrostatic latent image of the desired document on the photoreceptor's surface. Toner particles are then deposited onto that latent image, forming a toner image. That toner image is then transferred from the photoreceptor onto a substrate, such as a sheet of paper. The transferred toner image is then fused to the substrate, usually using heat and/or pressure, thereby creating a permanent image. The surface of the photoreceptor is then cleaned of residual developing material and recharged in preparation for the production of another image.

The foregoing broadly describes a prototypical black and white electrophotographic printing machine. Electrophotographic marking can also produce color images by repeating the above process once for each color of toner that is used to make the composite color image. For example, in one color process, referred to herein as the REaD IOI process (Recharge, Expose, and Develop, Image On Image), a charged photoreceptive surface is exposed to a light image which represents a first color, say black. The resulting electrostatic latent image is then developed with black toner particles to produce a black toner image. The charge, expose, and develop process is repeated for a second color, say yellow, then for a third color, say magenta, and finally for a fourth color, say cyan. The various color toner particles are placed in superimposed registration such that a desired composite color image results. That image is then transferred and fused onto a substrate.

The REaD IOI electrophotographic printing process described above is an example of a "process color" machine in which "subtractive" color toners, usually cyan, magenta, and yellow, are combined to make an image of various colors and tones. A process color machine locates various colors of toner on top of and adjacent to each other such that the human eye blends the colors together to form a composite image. While process color printing is required for imaging pictorials, it is not optimum for highlight color printing. In highlight color printing a particular saturated color, often deep red, is desired in a particular location. The problem with process color printing for highlight color applications is that it is inefficient in producing the often used "additive" primary colors such as red because two separations are required (magenta and yellow in the case of red) and often the subtractive toners are unable to produce the highlight color hue and chroma that is desired.

Highlight color machines typically use at least black and red toners. For example, most of a bill might be printed in black, but the payment due might be printed in red so as to stand out from the rest of the bill. Red, green, and blue are "additive" colors. That is, they absorb two thirds of the visible spectrum. For this reason they are unsuitable for process color applications because placing two of the colors on top of each other produces black (or a dark brown), not another color. Thus additive color toners cannot be used in prior art REaD IOI printing to produce a variety of colors. With additive color toners it is very important to suppress, rather than to enhance image-on-image (IOI) development.

REaD electrophotographic printing is subject to various REaD interactions. A REaD interaction is a process problem encountered when trying to develop toner on toner. A first REaD interaction is the loss of exposure due to light scattering and absorption by previously developed toner layers. Essentially, to expose the photoreceptor the exposing light must pass through one or more toner layers. A second REaD interaction involves the loss of electrostatic contrast when developing a toner on previously developed toner because of the voltage drop across the developed toner. A third REaD interaction involves development losses due to problems encountered when developing over thicker dielectrics. Since the foregoing REaD interactions all result from previously developed toner layers the basic problem then is developing an image on an image. Because highlight color printing is useful in many applications, and because REaD electrophotographic printing itself is a beneficial printing process, techniques of enabling quality REaD printing using additive color toners would be beneficial. Since it is desired to suppress image-on-image development for this application, the REaD interactions can be used to our advantage rather than to our disadvantage.

SUMMARY OF THE INVENTION

This invention provides for REaD electrophotographic printing using additive color toners by inhibiting image on image development. Image on image development is beneficially inhibited by setting the exposure set point such that exposure losses when imaging through toner reduce the electrostatic developing potential such that toner on toner development is reduced. Alternatively, or additionally, image on image development is beneficially inhibited by using a DC corona system (such as a DC scorotron) during recharging so as to enhance the voltage drop across previously developed toner. Again, toner on toner development is reduced. Alternatively, or additionally, image on image development is beneficially inhibited by increasing the developed toner mass to increase the dielectric properties of developed toner. Once again, toner on toner development is reduced

BRIEF DESCRIPTION OF THE DRAWINGS

Other aspects of the present invention will become apparent as the following description proceeds and upon reference to the following drawings, in which like reference numerals identify like elements and wherein.

DETAILED DESCRIPTION OF A PREFERRED EMBODIMENT OF THE INVENTION

Figure 1:
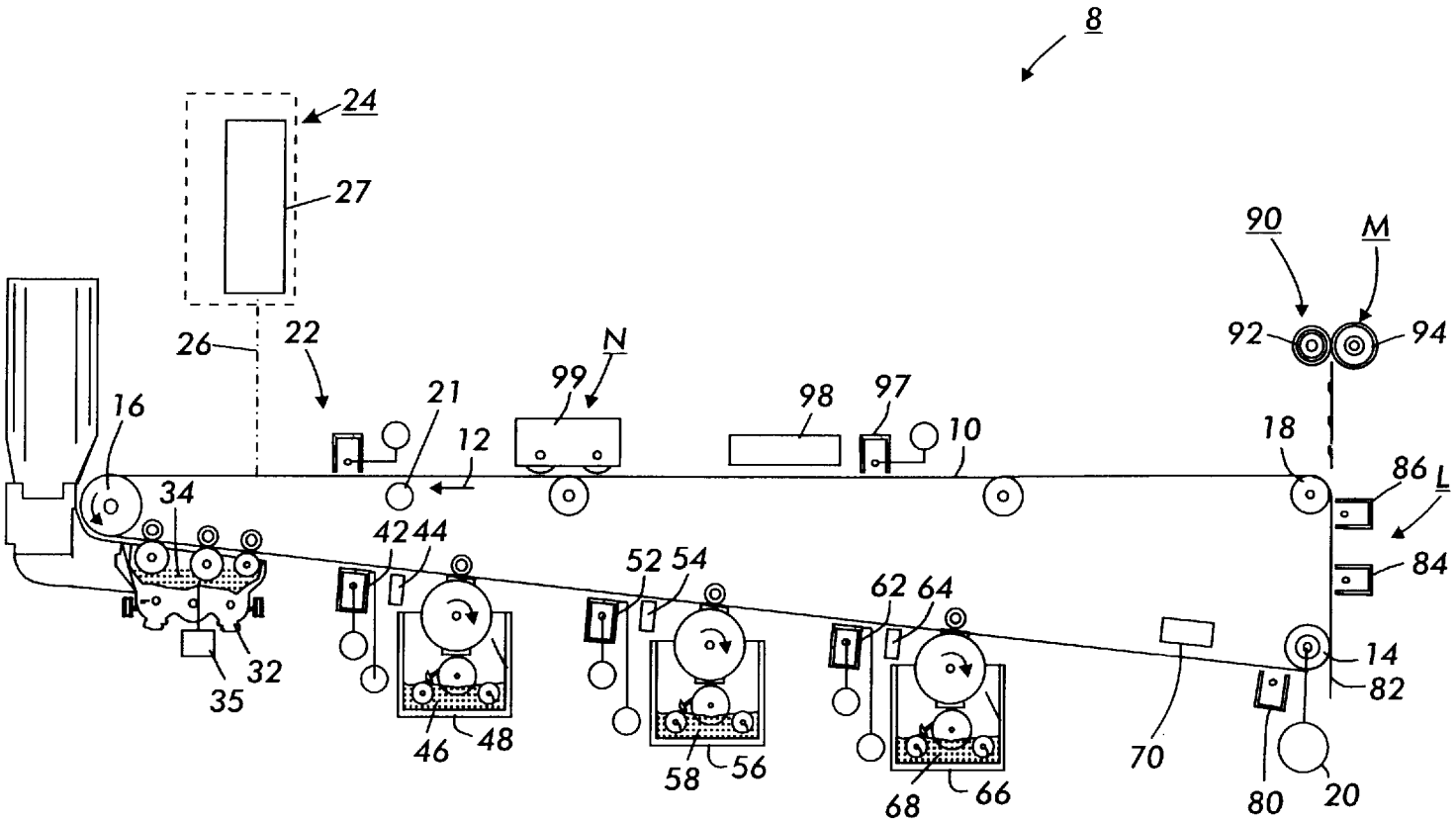
FIG. 1 shows an electrophotographic printing machine that incorporates the principles of the present invention.

Refer now to FIG. 1 wherein a preferred embodiment of the present invention is implemented in an electrophotographic printing machine 8 which uses additive color toner. While the printing machine 8 includes a plurality of individual subsystems that are well known in the art, they are implemented in a new, non-obvious, and useful way.

The printing machine 8 includes an Active Matrix (AMAT) photoreceptor belt 10 which travels in the direction indicated by the arrow 12. Belt travel is brought about by mounting the photoreceptor belt about a driven roller 14 and tension rollers 16 and 18. The driven roller 14 is driven by a motor 20.

As the photoreceptor belt travels each part of it passes through each of the subsequently described process stations. For convenience, a single section of the photoreceptor belt, referred to as the image area, is identified. The image area is that part of the photoreceptor belt which is to receive the various actions and toner layers which produce the final color image. While the photoreceptor belt may have numerous image areas, since each image area is processed in the same way a description of the processing of one image area suffices to explain the operation of the printing machine 8.

The imaging process begins with the image area passing a "precharge" erase lamp 21 that illuminates the image area so as to cause any residual charge which might exist on the image area to be discharged. Such erase lamps are common in high quality systems.

As the photoreceptor belt continues its travel the image area passes a charging station comprised of a DC corotron 22 that charges the image area in preparation for exposure to create a latent image. For example, the DC corotron might charge the image area to a substantially uniform potential of about −500 volts. It should be understood that the actual charge placed on the photoreceptor will depend upon many variables, such as toner mass to be developed and the settings of the development stations (see below).

After passing through the charging station the image area advances until it reaches an exposure station 24. At the exposure station the charged image area is exposed to a modulated laser beam 26 from a raster output scanner 27 that raster scans the image area such that an electrostatic latent representation of a black image is produced. For example, illuminated sections of the image area might be discharged by the beam 26 to about −100 volts. Thus after exposure the image area has a voltage profile comprised of relatively high voltage areas of about −500 volts and of relatively low voltage areas of about −100 volts. Raster output scanners are frequently used in high quality systems.

After passing the exposure station 24 the exposed image area with the black latent image passes a black development station 32 that advances black toner 34 onto the image area so as to develop the black latent image. Bias for the black development station 32 is derived from a power supply 35. Electrical biasing is such as to effect discharged area development (DAD) of the lower (less negative) of the two voltage levels on the photoreceptor. The charged black toner 34 adheres to the exposed areas of the image area, thereby causing the voltage of the illuminated parts of the image area to be about −200 volts. The non-illuminated parts of the image area remain at about −500 volts.

It should be clearly understood that while the black toner 34, and the other colors of toner that are described subsequently, are shown as dry toner, liquid toners can also be used.

The printing machine 8 beneficially departs from prior art REaD printing machines by developing what would previously be considered an excessive amount of black toner. Indeed, all of the developers that are discussed subsequently (except possibly the last developer) produce relatively large toner masses. One reason for this is that large toner masses assist in inhibiting image on image development. This is because large toner masses are associated with thick dielectric layers, and thick dielectric layers are known to inhibit image on image development.

While the black development station 32 could be a magnetic brush developer as shown, a scavengeless developer may be somewhat better. One benefit of scavengeless development is that it does not disturb previously deposited toner layers. Since black is the first developed toner layer, the use of scavengeless development is not required. However, since the other development stations (described below) beneficially use scavengeless development it may be better to use scavengeless development exclusively.

After passing the black development station 32 a DC scorotron 42 recharges the image area and its black toner layer. This DC recharge step increases the toner charge and the toner layer voltage. This is in direct contrast to REaD IOI printing wherein sophisticated recharging schemes are used to minimize the toner layer voltage without adding an abundance of opposite polarity ions which cause other unwanted effects. These sophisticated recharge schemes are needed since increased toner layer voltage inhibits the development of image on image toner layers. The printing machine 8 takes advantage of this since, with additive color toners, this inhibiting effect is beneficial.

The recharged image area with its black toner layer then advances to a blue exposure station 44, which is very much like the black exposure station 24. The blue exposure station 44 exposes the image area with a laser beam so as to produce an electrostatic latent representation of a blue image. As an example of the charges on the image area, the non-illuminated parts of the image area might have a potential about −500 while the illuminated areas that were previously developed with black toner particles might be discharged to about −250 volts, while the illuminated areas that were not previously developed might be discharged to about −100 volts. These voltages are exemplary only, actual voltages will depend upon many factors.

After passing the blue exposure station 44 the now re-exposed image area advances past a blue development station 46 that deposits blue toner 48 onto the image area. The blue development station is beneficially a scavengeless developer. As additive color toners are used in the printing machine 8 it is beneficial to prevent developing blue toner on the black toner. This is accomplished by setting the exposure verses photoreceptor potential profile, called the photo-induced discharge curve, such that development of the least negative areas are developed (in the example the areas discharged to about −100) while inhibiting development of more negative areas (the areas at −500 and −250 volts in the example).

Figure 2:
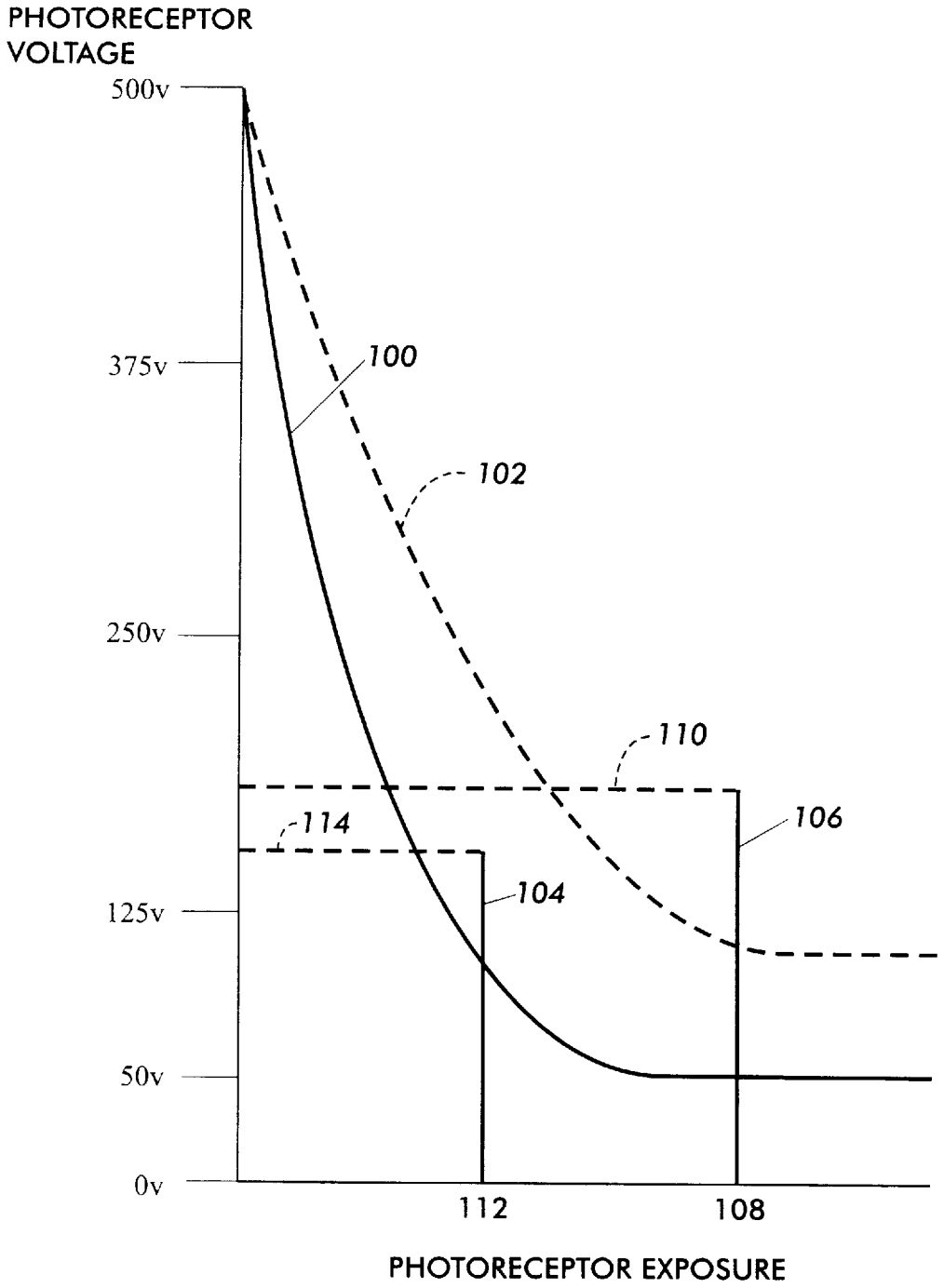
FIG. 2 illustrates the photo-induced discharge curves, and thus electrostatic contrasts, of image on image development as in the prior art and inhibited image on image development in accordance with the principles of the present invention.

FIG. 2 shows an exemplary set of photo-induced discharge curves. The vertical axis denotes negative photoreceptor voltage while the horizontal axis denotes (in some convenient unit such as lumens per steradian) the exposure of the photoreceptor by the exposure station 44. The curve 100 represents an exemplary plot of the photoreceptor voltage verses photoreceptor exposure when the exposing light does not pass through a previously developed layer. The curve 102 represents an exemplary plot of the photoreceptor voltage verses photoreceptor exposure when the exposing light does pass through a previously developed layer. The vertical line 104 represents exemplary exposure and development set points in the printing machine 8. The vertical line 106 represents exemplary exposure and development set points in a prior art REaD IOI printing machine.

In prior art REaD IOI printing machines the exposure stations are set such that the photoreceptor is exposed by illumination at a level 108 (at the base of the setpoint line 106). That exposure ensured that the photoreceptor voltage dropped below the development threshold 110 (at the top of the setpoint line 106). Therefore, after exposure toner particles would be developed on the exposed areas, causing image on image development.

In contrast, in the printing machine 8 the exposure station 44 (as well as the subsequently described exposure stations) is set such that the photoreceptor is exposed by illumination only at a level 112 (at the base of the setpoint line 104). This ensures that the photoreceptor voltage drops below the development threshold 114 (at the top of the setpoint line 104) when the illumination is directly onto the photoreceptor. However, the development threshold 114 is below the photoreceptor voltage that occurs when illumination at a level 112 passes through an existing toner layer (that is, below the line 102). Therefore, toner particles are subsequently developed on areas having a potential below the development threshold 114, but not those above. Thus image on image development is inhibited.

After passing the blue development station 46 the image area is recharged by a DC scorotron 52, which increases the toner charge and voltage so as to inhibit image on image development in the same manner as the DC scorotron 42. The recharged image area with its black and blue toners then advances to a green exposure station 54, which is very much like the exposure stations 24 and 44, except that the green exposure station 54 exposes the image area to produce an electrostatic latent representation of a green image.

After passing the green exposure station 54 the now re-exposed image area advances past a green development station 56 that deposits green toner 58 onto the image area. Like the blue development station, the green development station operates such that development of the least negative areas are developed (in the example the areas discharged to about −100) while inhibiting development of more negative areas (the areas at −500 and −250 volts in the example). Reference the foregoing discussion of FIG. 2.

After passing the green development station 54 the image area is recharged by a DC scorotron 62, which again enhances "opposite polarity" toner charges so as to inhibit image on image development in the same manner as the DC scorotrons 42 and 52. The recharged image area with its black, blue, and green toners then advances to a red exposure station 64, which is very much like the exposure stations 24, 44, and 54, except that the red exposure station 64 exposes the image area to produce an electrostatic latent representation of a red image.

After passing the red exposure station 64 the now re-exposed image area advances past a red development station 66 that deposits red toner 68 onto the image area. Like the blue and green development stations, the red development station operates such that development of the least negative areas are developed (in the example the areas discharged to about −100) while inhibiting development of more negative areas (the areas at −500 and −250 volts in the example).

After passing the red development station the image area has four colors of toner which together make up a composite color toner image. Those four colors of toner have been produced using a process in which image on image development has been inhibited. By avoiding image on image development the muddy brown color that results when toners overlap is avoided. While this is itself beneficial, another benefit results: color registration requirements are eased. A simple case illustrates this point. Assume that a color that is 50% red and 50% blue is desired. The blue image can be produced in a checkerboard pattern of blue pixels with open (undeveloped) spaces. The red pixels need not be registered to exactly fit the open spaces. In fact, a solid red exposure could be performed. Since the red toner will not develop on the existing blue checkerboard, only the open spaces would be developed.

After passing the red development station the composite color toner image is comprised of individual toner particles which have charge potentials which vary widely. Directly transferring such a composite toner image onto a substrate would result in a degraded final image. Therefore it is beneficial to prepare the composite color toner image for transfer.

To prepare for transfer a pretransfer erase lamp 70 discharges the image area to produce a relatively low charge level on the image area. The image area then passes a pretransfer DC scorotron 80 which performs a pre-transfer charging function. The image area continues to advance in the direction 12 past the driven roller 14. A substrate 82 is then placed over the image area using a sheet feeder (which is not shown). As the image area and substrate continue their travel they pass a transfer corotron 84. That corotron applies positive ions onto back of the substrate 81. Those ions attract the negatively charged toner particles onto the substrate.

As the substrate continues its travel is passes a detack corotron 86. That corotron neutralizes some of the charge on the substrate to assist separation of the substrate from the photoreceptor 10. As the lip of the substrate 82 moves around the tension roller 18 the lip separates from the photoreceptor. The substrate is then directed into a fuser 90 where a heated fuser roller 92 and a pressure roller 94 create a nip through which the substrate 82 passes. The combination of pressure and heat at the nip causes the composite color toner image to fuse into the substrate. After fusing, a chute, not shown, guides the substrate to a catch tray, also not shown, for removal by an operator.

After the substrate 82 is separated from the photoreceptor belt 10 the image area continues its travel and passes a preclean corotron 97 that neutralizes most of the residual charges on the photoreceptor. The image area then passes a preclean erase lamp 98. That lamp neutralizes most of the charges remaining on the photoreceptor belt. After passing the preclean erase lamp the residual toner and/or debris on the photoreceptor is removed at a cleaning station 99. The image area then passes once again to the precharge erase lamp 21 and the start of another cycle.

Using well known technology the various machine functions described above are generally managed and regulated by a controller which provides electrical command signals for controlling the operations described above.

It is to be understood that while the figures and the above description illustrate the present invention, they are exemplary only. Others who are skilled in the applicable arts will recognize numerous modifications and adaptations of the illustrated embodiments which will remain within the principles of the present invention. For example, the foregoing has described a single pass REaD printing machine. Other implementations are possible. For example, the principles of the present invention could be applied in a four pass printer, wherein only one color toner image is produced during each pass of the photoreceptor through the machine and wherein the composite color image is transferred and fused during the fourth pass. Another implementation might be in a five cycle printer, wherein only one color toner image is produced during each pass of the photoreceptor through the machine, but wherein the composite color image is transferred and fused during a fifth pass through the machine. Therefore, the present invention is to be limited only by the appended claims.

What is claimed:

1. A color printing machine, comprising:

a photoreceptor having at least one image area;

a first charging station for charging said image area;

a first exposure station for exposing said image area so as to produce a first latent image;

a developing station for depositing a first color of toner on said first latent image;

a second charging station for recharging said image area;

a second exposure station for exposing said image area so as to produce a second latent image that overlaps said first latent image;

a second developing station for depositing a second color of toner on said second latent image, wherein said second color of toner is an additive color;

a third charging station for recharging said image area;

a third exposure station for exposing said image area so as to produce a third latent image that overlaps said first and second latent images; and a third developing station for depositing a third color of toner on said third latent image, wherein said third color of toner is an additive color;

wherein said second exposure station exposes said image area with a light intensity such that said second developing station develops bare sections of said image area but is inhibited from developing previously developed sections.

2. A color printing machine according to claim 1, wherein said second charging station is a constant voltage DC corona generator.

3. A color printing machine according to claim 1, wherein said first color of toner is black.

4. A color printing machine according to claim 1, wherein said second color of toner is blue, red, or green.

5. A color printing machine according to claim 1, further including:

a fourth charging station for recharging said image area;

a fourth exposure station for exposing said image area so as to produce a fourth latent image that overlaps said first, second, and third latent images; and a fourth developing station for depositing a fourth color of toner on said fourth latent image, wherein said fourth color of toner is an additive color.

6. A color printing machine according to claim 1, wherein said first color of toner is developed such that a developed mass inhibits image on image development.

* * * * *